US006739565B1

(12) United States Patent
Spadafora

(10) Patent No.: US 6,739,565 B1
(45) **Date of Patent: *May 25, 2004**

(54) TRASH CAN HOLD DOWN APPARATUS

(76) Inventor: Michael Spadafora, 404 Wegman Rd., Reading, PA (US) 19606

( * ) Notice: Subject to any disclaimer, the term of this patent is extended or adjusted under 35 U.S.C. 154(b) by 0 days.

This patent is subject to a terminal disclaimer.

(21) Appl. No.: 09/977,616

(22) Filed: Oct. 15, 2001

(51) Int. Cl.[7] ..... A47B 97/00; B65F 1/12

(52) U.S. Cl. ..... 248/500; 248/154; 248/907; 248/205.2; 220/630; 220/908

(58) Field of Search ..... 248/154, 500, 248/506, 152, 205.2, 907, 683, 507; 220/630, 675, 262, 263, 908, 909, 910, 913; D34/9, 10

(56) References Cited

U.S. PATENT DOCUMENTS

| | | | | | |
|---|---|---|---|---|---|
| 474,082 | A | * | 5/1892 | Dewey | 248/346.04 |
| 1,101,286 | A | * | 6/1914 | Jones | 220/824 |
| 1,171,210 | A | * | 2/1916 | Keffer | 215/386 |
| 1,228,813 | A | * | 6/1917 | Osley | 248/154 |
| 1,286,368 | A | * | 12/1918 | Lucas | 220/502 |
| 1,598,135 | A | * | 8/1926 | Heinson et al. | 220/813 |
| 1,739,588 | A | * | 12/1929 | Greene | 248/146 |
| 1,828,249 | A | * | 10/1931 | Hammond | 220/DIG. 8 |
| 1,837,411 | A | * | 12/1931 | Cutter | 248/154 |
| 1,911,724 | A | * | 5/1933 | Stein | 220/495.11 |
| 2,112,155 | A | * | 3/1938 | Haney et al. | 248/149 |
| 2,140,862 | A | * | 12/1938 | Sumner | 248/154 |
| 2,150,784 | A | * | 3/1939 | Roehm | 131/240.1 |
| 2,153,679 | A | * | 4/1939 | Rich | 248/501 |
| 2,208,860 | A | * | 7/1940 | Smart | 220/DIG. 8 |
| 2,287,919 | A | * | 6/1942 | Ulzheimer | 211/85.4 |
| 2,402,175 | A | * | 6/1946 | Mapes | 220/565 |
| 2,499,612 | A | * | 3/1950 | Staver | 174/35 TS |
| 2,520,725 | A | * | 8/1950 | Judd | 174/35 TS |
| 3,295,802 | A | * | 1/1967 | Leatherman | 248/523 |
| 3,306,486 | A | * | 2/1967 | Martino et al. | 220/254.3 |
| 3,387,341 | A | * | 6/1968 | Mates et al. | 24/306 |
| 4,072,286 | A | | 2/1978 | Foncannon | 248/154 |
| 4,363,417 | A | | 12/1982 | Rhoades | 220/1 T |
| 4,416,197 | A | | 11/1983 | Kehl | 100/214 |
| 4,558,796 | A | | 12/1985 | Jaicks | 220/1 T |
| 4,591,148 | A | * | 5/1986 | Slater | 128/DIG. 15 |
| 4,643,380 | A | * | 2/1987 | Copeland | 248/97 |
| 4,969,618 | A | * | 11/1990 | Thompson | 248/152 |
| 4,971,276 | A | * | 11/1990 | Tannenbaum | 248/154 |
| D318,597 | S | * | 7/1991 | Schultz | D7/590 |
| 5,118,064 | A | * | 6/1992 | Gonsalves | 248/154 |
| 5,163,579 | A | | 11/1992 | Jones | 220/629 |
| D332,334 | S | * | 1/1993 | Jones | D34/9 |
| 5,566,919 | A | * | 10/1996 | Shephard | 248/604 |
| 5,690,247 | A | | 11/1997 | Boover | 220/403 |
| D398,122 | S | * | 9/1998 | Presock et al. | D34/9 |
| 5,890,693 | A | * | 4/1999 | Do et al. | 248/346.03 |
| D418,958 | S | * | 1/2000 | Wood et al. | D34/9 |
| 6,102,343 | A | | 8/2000 | Grimesey | 248/95 |
| 6,168,057 | B1 | * | 1/2001 | Schwabe | 224/269 |
| 6,412,745 | B1 | * | 7/2002 | Yokoyama et al. | 248/500 |
| 6,464,184 | B1 | * | 10/2002 | Lytle | 248/126 |
| D467,697 | S | * | 12/2002 | Spadafora | D34/10 |

* cited by examiner

*Primary Examiner*—Norie Chan
*Assistant Examiner*—Naschica S. Morrison
(74) *Attorney, Agent, or Firm*—Miller Law Group, PLLC

(57) ABSTRACT

A trash can hold down apparatus is attached to the sides of a conventional household trash can to permit engagement by a person's feet to restrain vertical movement of the trash can when the trash bag liner is removed from the trash can. The hold down apparatus is formed with an upright portion and an integral engagement portion that projects generally orthogonally from the upright portion. The engagement portion is free to move relative to the upright portion to allow the engagement portion to rest on the surface of the floor irrespective of the angle at which the upright portion is attached to the sides of the conventional household trash can. The upright portion is provided with an adhesive attachment device to fix the upright portion to the sides of the trash can. Preferably, the attachment device is in the form of a hook and loop fastener to permit the hold down apparatus to be detached from the trash can. The engagement portion is formed with a ridge to provide some limited rigidity at a distance spaced from the upright portion so as to not affect the flexibility of the apparatus in mounting to different configurations of trash cans.

19 Claims, 5 Drawing Sheets

TRASH CAN HOLD DOWN APPARATUS

BACKGROUND OF THE INVENTION

This invention relates generally to household trash cans and, more particularly, to a device for attachment to the outside of the trash can to be utilized in holding the trash can down when removing a filled trash bag therefrom.

Household trash cans are typically used with a disposable plastic film trash bag which lines the trash can. After filling the trash can, the bag is then removed from the trash can and then disposed, following which another plastic bag is then inserted into the trash can. A common occurrence is the overfilling of the trash can which can result in compaction of the trash within the can, leading to difficulties in removing the bag from the can. In some instances, two people may be required to remove the filled trash bag, one to hold the trash can down and the other to lift the trash bag out of the restrained trash can.

Devices have been built into the structure of the household trash can to be operable for engagement with a person's foot to hold the trash can down while the bag liner is removed from the can. One instance of such as device can be found in U.S. Pat. No. 4,416,197, granted to Kehl, where a rim is formed at the bottom of the waste can to be engageable by a foot to enhance the removal of the liner bag by holding the waste can stationary. In U.S. Pat. No. 4,558,796, granted to Jaicks, flanges are formed into the bottom of the trash can to serve as supports for holding the can while fastening the lid thereto. Similarly, U.S. Pat. No. 5,690,247, issued to Boover, shows a foot engageable attachments at the bottom of the trash can. U.S. Pat. No. 6,102,343, issued to Grimsey, et al, not only provides an integral foot support but also an internal lift mechanism to assist in the removal of the trash bag liner. U.S. Pat. No. 5,163,579, issued to Jones, teaches a pivoted, retractable foot pedal for holding down the trash can.

None of these prior art references, however, teach a device that can be packaged and sold independently of the trash can to be added to the outside of the trash can after the initial sale of the can. Forming the bottom of the trash can with the foot engageable supports as taught in the above-described prior art references, limits the flexibility of the manufacturer in manufacturing and shipping the trash cans. Generally, household trash cans are formed in a configuration having upwardly diverging sides to form a receptacle having a wider top than the bottom. Such a configuration is conducive to stacking and shipping in s generally compact manner. Forming outwardly projecting foot supports on the bottom of the trash can prevents such compact stacking and shipping, unless retractable, as taught in U.S. Pat. No. 5,163,579 (Jones) described above. Retractable foot pedals or recessed foot supports, as taught in U.S. Pat. No. 4,363,417, granted to Rhoades, et al., and U.S. Pat. No. 5,690,247 (Boover), reduce the usable volume of the receptacle for holding trash.

Accordingly, it would be desirable to provide a device that can be attached to the outer circumferential surface of a household trash can after the trash can has been sold. Such a device could be packaged and sold independently of the trash can.

SUMMARY OF THE INVENTION

It is an object of this invention to overcome the aforementioned disadvantages of the prior art by providing a trash can hold down apparatus that can be attached to the trash can after the sale thereof.

It is another object of this invention to provide a trash can hold down apparatus that can be packaged and sold separately and independently of the sale of the trash can.

It is a feature of this invention that the trash can hold down apparatus can be fastened to the outside of a conventional trash can by an adhesive attachment apparatus.

It is an advantage of this invention that the adhesive attachment apparatus includes a hook and loop detachable fastener.

It is another advantage of this invention that the trash can hold down apparatus can be attached to a variety of different types of trash cans.

It is another feature of this invention that the trash can hold down apparatus is formed with an upright portion that is affixed to the side of the trash can and an engagement portion that projects generally orthogonally from the upright portion.

It is still another object of this invention to provide a trash can hold down apparatus that can be adapted to fit substantially all configurations of household trash cans.

It is still another feature of this invention that the waste can hold down apparatus is sufficiently flexible between the upright portion and the engagement portion to permit the engagement portion to move relative to the upright portion.

It is still another advantage of this invention that the engagement portion can be positioned to rest on the surface of the floor irrespective of the angular orientation of the upright portion attached to a conventional household trash can.

It is yet another feature of this invention that the engagement portion is formed with a ridge to provide some rigidity to the engagement portion.

It is yet another advantage of this invention that the ridge formed in the engagement portion is positioned at a sufficient distance from the upright portion to not restrict the flexibility between the upright and engagement portions.

It is yet another object of this invention to provide a hold down apparatus that can be attached to opposing sides of a household trash can to permit foot engagement for restraining vertical movement of the trash can while removing the liner bag therefrom.

It is still a further feature of this invention that the hold down apparatus can be detached from the sides of the trash can to permit storage thereof in a compact manner.

It is yet another object of this invention to provide a trash can hold down apparatus that is durable in construction, inexpensive of manufacture, carefree of maintenance, facile in assemblage, and simple and effective in use.

These and other objects, features and advantages are accomplished according to the instant invention by providing a trash can hold down apparatus that can be attached to the sides of a conventional household trash can to permit engagement by a person's feet to restrain vertical movement of the trash can when the trash bag liner is removed from the trash can. The hold down apparatus is formed with an upright portion and an integral engagement portion that projects generally orthogonally from the upright portion. The engagement portion is free to move relative to the upright portion to allow the engagement portion to rest on the surface of the floor irrespective of the angle at which the upright portion is attached to the sides of the conventional household trash can. The upright portion is provided with an adhesive attachment device to fix the upright portion to the sides of the trash can. Preferably, the attachment device is in the form of a hook and loop fastener to permit the hold down apparatus to be detached from the trash can. The engagement portion is formed with a ridge to provide some limited rigidity at a distance spaced from the upright portion so as to not affect the flexibility of the apparatus in mounting to different configurations of trash cans.

BRIEF DESCRIPTION OF THE DRAWINGS

The advantages of this invention will become apparent upon consideration of the following detailed disclosure of the invention, especially when taken in conjunction with the accompanying drawings wherein.

DETAILED DESCRIPTION OF THE PREFERRED EMBODIMENT

Figure 1:
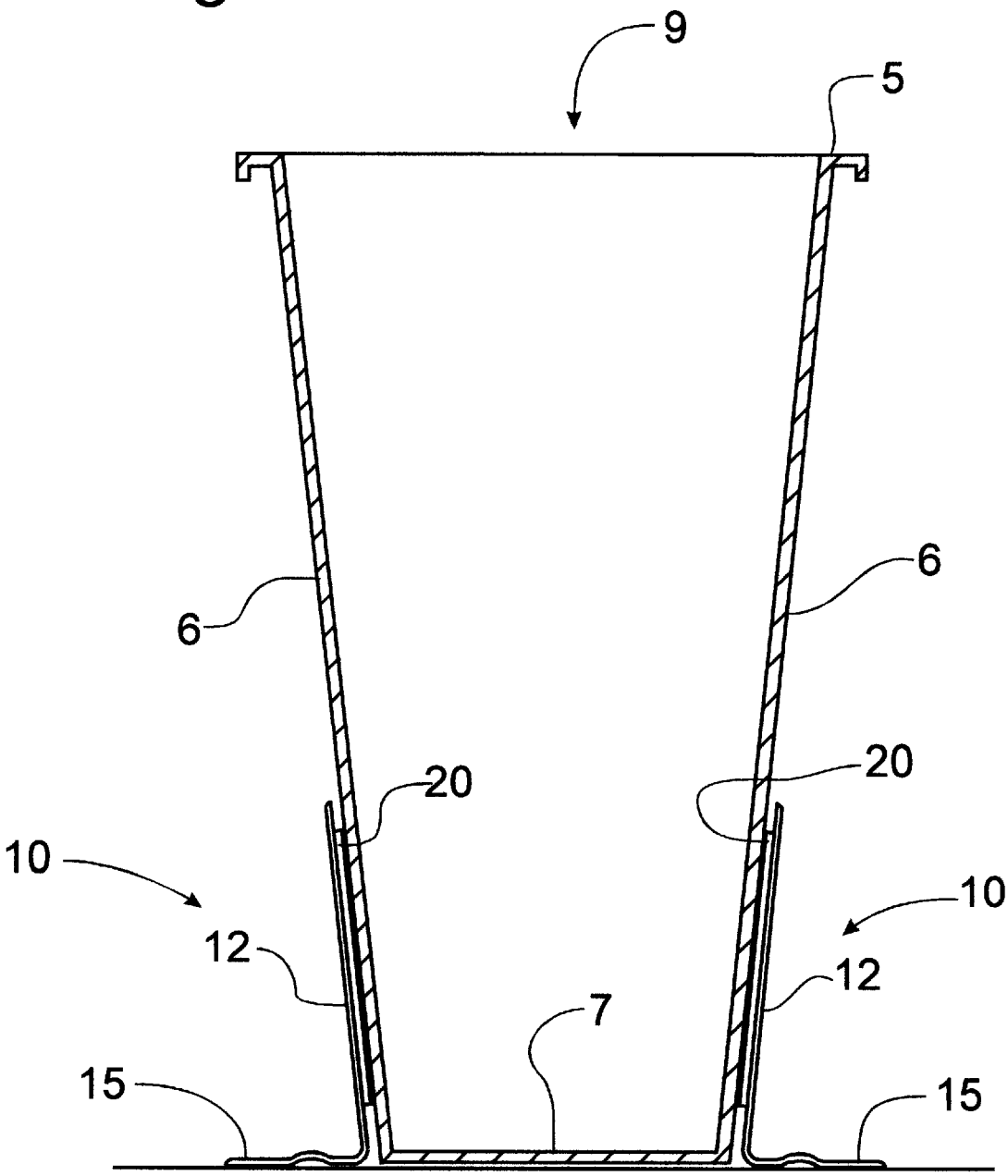
FIG. 1 is a cross-sectional view through a representative conventional household trash can having a pair of trash can hold down devices attached to opposing sides thereof.
Figure 2:
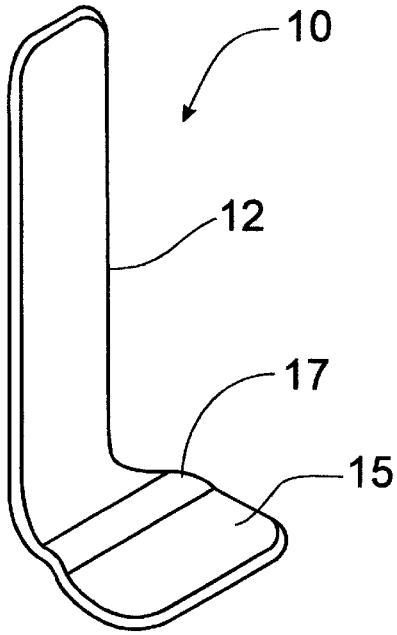
FIG. 2 is right-front perspective view of the trash can hold down apparatus incorporating the principles of the instant invention.
Figure 3:
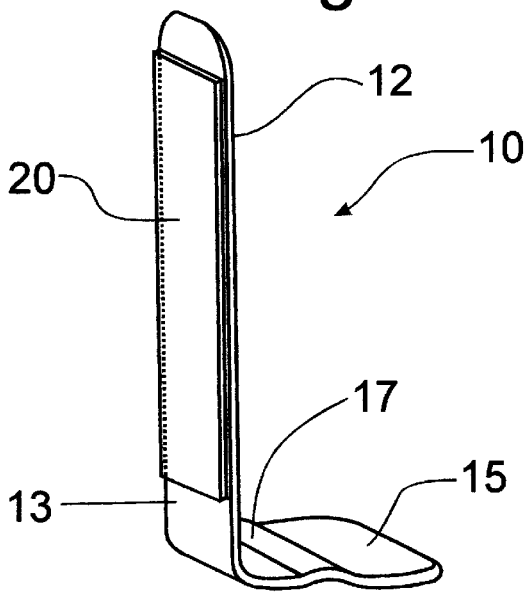
FIG. 3 is a right-rear perspective view of the trash can hold down apparatus shown in FIG. 2, the adhesive attachment device being shown affixed to the rear of the upright portion of the apparatus.
Figure 4:
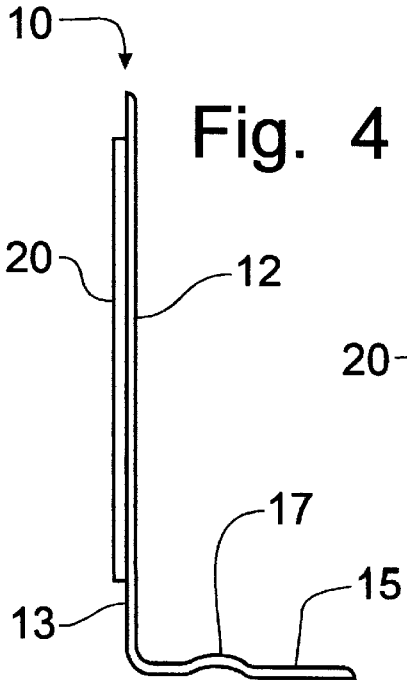
FIG. 4 is a side elevational view of the trash can hold down apparatus with the adhesive attachment device affixed to the rear thereof as seen in FIG. 3.
Figure 5:
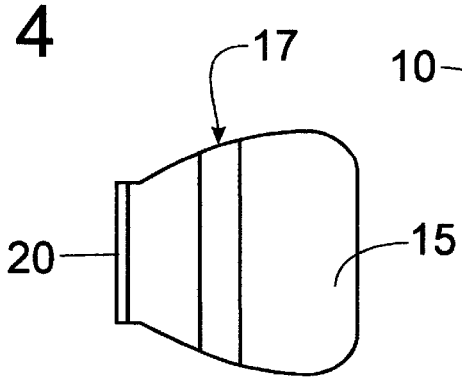
FIG. 5 is a bottom plan view of the trash can hold down apparatus shown in FIG. 4.
Figure 6:
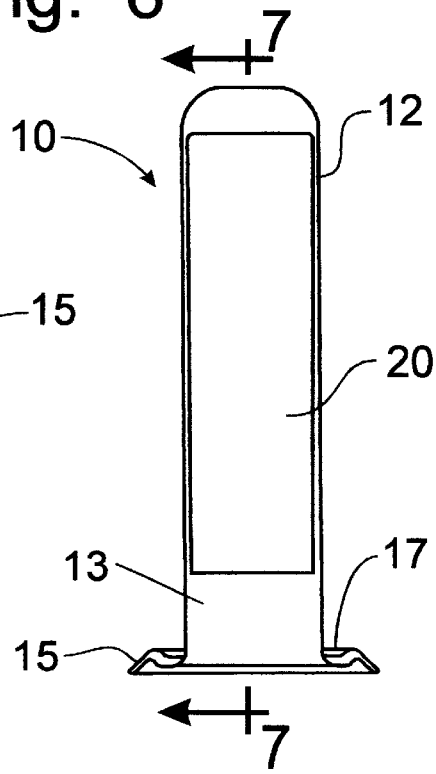
FIG. 6 is a rear elevational view of the trash can hold down apparatus shown in FIGS. 4 and 5.
Figure 7A:
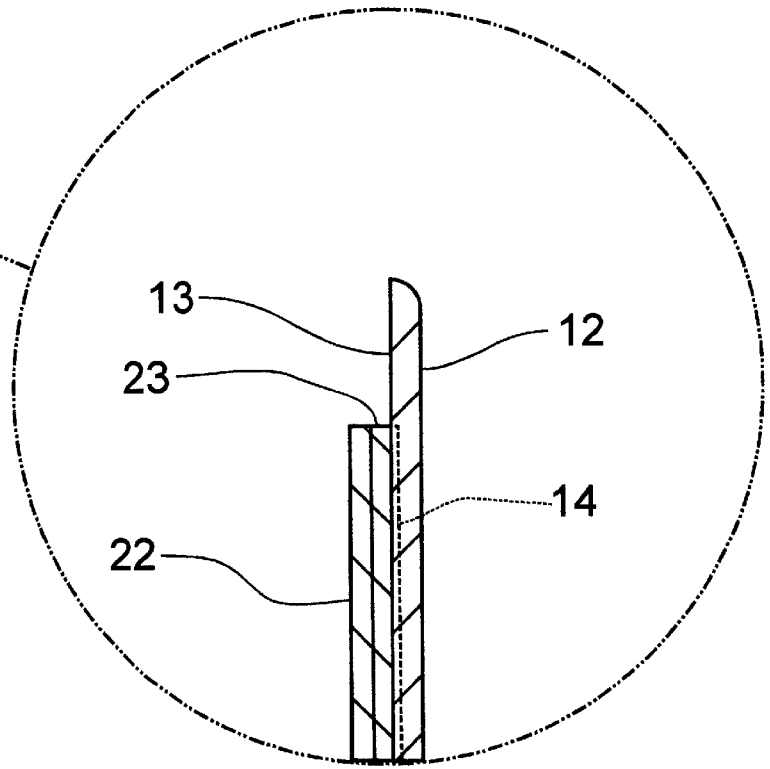
FIG. 7*a* is an enlarged cross-sectional detail view of the top of the upright portion of the trash can hold down apparatus shown in FIG. 7.
Figure 7:
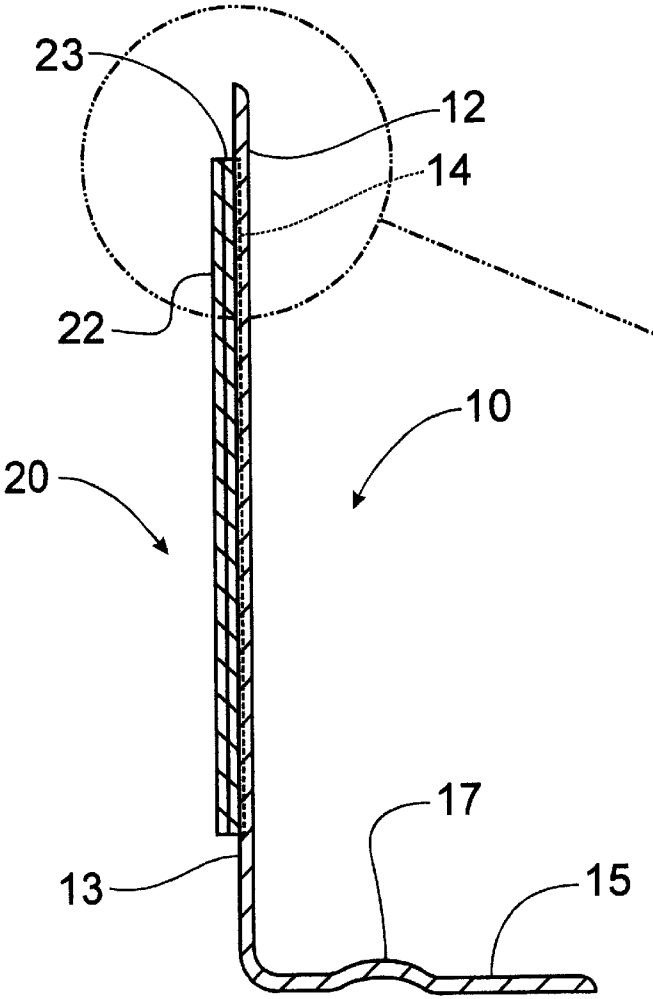
FIG. 7 is an enlarged cross-sectional view of the trash can hold down apparatus taken along lines 7—7 of FIG. 6.
Figure 9:
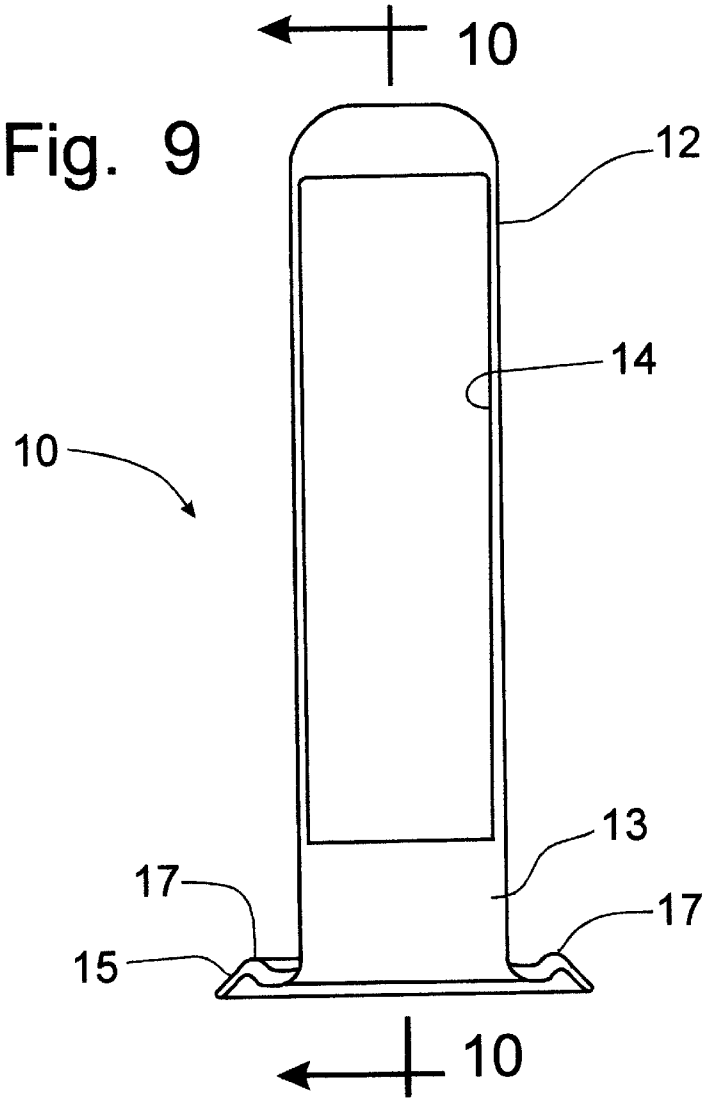
FIG. 9 is a rear view of the trash can hold down apparatus depicted in FIG. 8.
Figure 8:
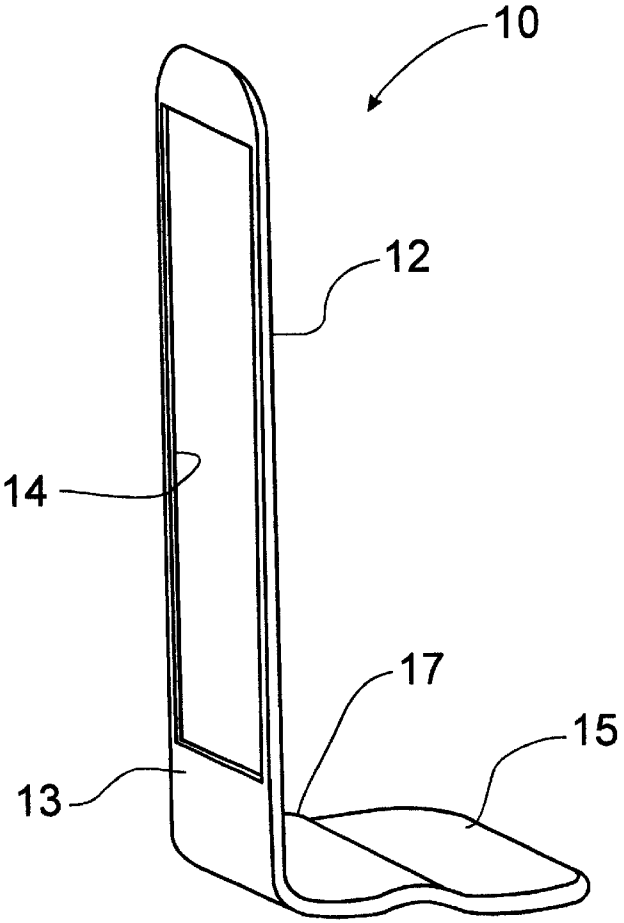
FIG. 8 is a right rear perspective view of the trash can hold down apparatus similar to FIG. 3, but without the adhesive attachment device affixed to the back of the upright portion.
Figures 10, 10A:
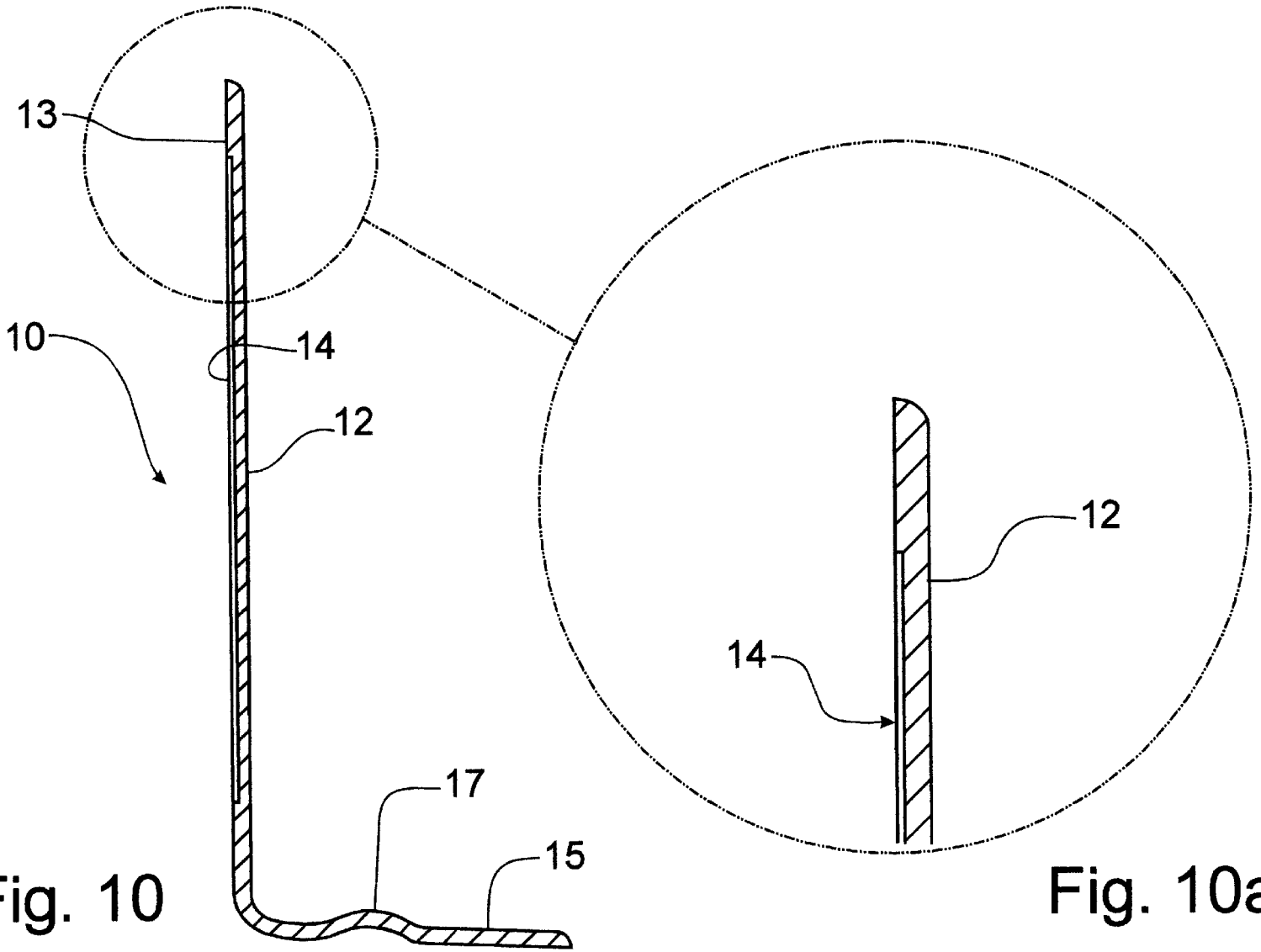
FIG. 10 is an enlarged cross-sectional view of the trash can hold down apparatus taken along lines 10—10 of FIG. 9.
FIG. 10*a* is an enlarged cross-sectional detail view of the top end of the upright portion depicted in FIG. 10.

Referring now to FIG. 1, the utilization of the trash can hold down apparatus incorporating the principles of the instant invention can best be seen. The trash can 5 is representative of a conventional household trash can having generally upright sides 6, a closed bottom 7 and an open top 9 through which a trash bag liner (not shown) is inserted to be filled with trash as is well know in the art. A hold down apparatus 10 is affixed to the opposing sides of the trash can 5 to be positioned for engagement by the feet of the person taking the trash bag liner out of the trash can after having been filled. As with most conventional household trash cans, the upright sides 6 of the trash can 5 are sloped slightly upwardly and outwardly to permit the nesting of a plurality of trash cans 5 for shipping purposes. While the upwardly opening nature of the trash can 5 facilitates the removal of a filled trash bag liner (not shown), an overfilling of the trash bag still results in difficulty in extracting the trash bag from the trash can 5. Engagement of the hold down apparatus 10 by the person's feet will restrain the vertical movement of the trash can 5 while upward force is exerted on the trash bag to extract it from the open top 9 of the trash can 5.

The structural details of the trash can hold down apparatus 10 can best be seen in FIGS. 2–10*a*. The hold down apparatus 10 is formed preferably through a molding process, such as injection molding, from plastic material, such as high density polyethylene. Structurally, the hold down apparatus 10 is formed with an upright portion 12 and an engagement portion 15 that projects generally orthogonally to the upright portion 12. The polyethylene or other plastic material will permit some flexing of the engagement portion 15 relative to the upright portion 12 so that the hold down apparatus 10 will be adaptable to fit substantially all forms of conventional household trash cans, irrespective of the shape or angular orientation of the upright walls 6. As seen in FIG. 1, the engagement portion 15 will rest on the floor of the surface on which the trash can 5 is resting, while the upright portion 12 will be attached to the side 6 of the trash can 5, which is not likely to be at right angles.

The engagement portion 15 is provided with a transversely wider footprint than the upright portion 12 because the engagement portion 15 needs to be easy to engage with a person's foot, while the upright portion 12 has to be small enough to facilitate attachment to a variety of shapes and sizes of trash cans 5. For example, the conventional trash can 5 can have a rounded configuration or a rectilinear shape. The upright portion 12 must adapt to and be operable to affix to each of these trash can shapes. Furthermore, the engagement portion 15 is formed with a ridge 17 extending transversely across the width of the engagement portion 15, but at a distance from the upright portion 12 so as to not affect the integrity of the flexibility between the upright and engagement portions 12, 15.

The upright portion 12 is preferably formed with a recessed portion 14 in the back side 13 of the upright portion 12 to provide enhanced engagement with the an adhesive attachment device 20. While the rear side 13 need not be formed with a recessed portion 14, the utilization thereof will enhance the proper positioning and engagement of the adhesive attachment device 20. The recessed portion can be seen best in FIGS. 8–10*a*. Preferably, the adhesive attachment device 20 will be in the form of a hook and loop fastening device 22, 23 having an adhesive connection for both the rear side 13 of the upright portion 12 and the side 6 of the trash can 5, as is depicted in FIG. 1. The use of the hook and loop fastener device 22, 23 will permit the detachment of the hold down apparatus 10 from the trash can 5 in the event the trash can 5 needs to be stored or shipped compactly.

Such a trash can hold down apparatus 10 can be packaged and sold independently of the trash can 5 and independently of the brand or manufacturer of the trash can 5. Manufacturing through an injection molding process enables the hold down apparatus 10 to be formed in substantially any color or pattern simply by adding dye to the plastic material or a pattern to the surface of the mold. Accordingly, the trash can hold down apparatus 10 can be marketed as an after-market option. Once so purchased, the hold down apparatus can be removed from the packaging. Preferably, the adhesive backed hook and loop fastener device 22, 23 has not yet been attached to the hold down apparatus 10, which would dictate that the protective covering would be removed from one side of the hook and loop fastener device 22, 23 and stuck to the rear side 13 of the upright portion within the recessed portion 14. Once so assembled, the hold down apparatus 10 can be aligned appropriately on the side 6 of the trash can 5 so that the upright portion 12 can engage the side 6 of the trash can 5 at a point where the engagement portion 15 will rest on the floor. Once the remaining protective backing has been removed from the hook and loop fastener device 22, 23, the hold down apparatus 10 can be affixed to the trash can 5.

Preferably, an extra strength hook and loop fastener device 22, 23, such as that marketed as "Velcro" will be used to attach the upright portion 12 of the hold down apparatus 10 to the trash can 5. Such an attachment device 20 is capable of withstanding substantial amounts of force, yet will separate between the hook side 22 and the loop side 23 to permit the hold down apparatus 10 to be detached from the side 6 of the trash can 5. Re-attachment can be attained simply by aligning the hood and loop fastener halves 22, 23 and pressing them together, as will be understood by one of ordinary skill in the art.

The adhesive attachment device 20 does not need to be a hook and loop fastener 22, 23, although such a fastener 22, 23 permits multiple detachments and re-attachments of the hold down apparatus 10. Substantially permanent attachment can be obtained through a super strong double-sided adhesive tape or foam tape (not shown). The use of the hook and loop fastener 22, 23 will provide some thickness to the attachment structure, as would the foam tape, so that any irregularities in the surface of the trash can 5 can be accommodated. For example, some plastic conventional household trash cans 5 are formed with a textured side 6, perhaps having a relief portion formed therein. The yielding thickness of the attachment structure 20 allows the upright portion 12 to be firmly affixed to the side 6 of the trash can 5 irrespective of the texture of the side 6 of the trash can 5. Furthermore, the long length of the upright portion 12 , which is at least twice as long as the engagement portion 15, enhances the connection of the hold down apparatus 10 as the long length of the upright portion 12 accommodates any irregularities in the side 6 of the trash can 5.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention.

Having thus described the invention, what is claimed is:

1. A hold down apparatus in combination with a trash can, the hold down apparatus for attachment to a generally upright side wall of a trash can resting on a floor support, the hold down apparatus comprising:

an upright portion attachable to said side wall of said trash can;

an engagement portion connected to said upright portion and extending generally orthogonally thereto and outwardly away from said side wall, said engagement portion being movable relative to said upright portion so as to rest on said floor support irrespective of the angular orientation of said upright portion when attached to said side wall of said trash can, said engagement portion being positionable for temporary external engagement to restrain upward movement of said trash can when said upright portion is attached to said side wall; and an attachment device for connecting said upright portion to said side wall of said trash can so as to be movable with said trash can, said attachment device including a first portion having an adhesive surface to permit said first portion to be affixed to said side wall of said trash can and a second portion affixed to said upright portion, said first and second portions of said attachment device being selectively disengagable to permit said apparatus to be removed from said side wall of said trash can.

2. The apparatus of claim 1 wherein said engagement portion has a transverse width greater than said upright portion.

3. The apparatus of claim 2 wherein said engagement portion is formed integrally with said upright portion.

4. The apparatus of claim 3 wherein said engagement portion is formed with an arched ridge extending across the transverse width of said engagement portion to provide some rigidity to said engagement portion.

5. The apparatus of claim 4 wherein said arched ridge is spaced from said upright portion so as to not restrict movement of said engagement portion relative to said upright portion.

6. The apparatus of claim 1 wherein said upright portion has a rear side formed with a recessed portion into which said attachment device is affixed.

7. The apparatus of claim 6 wherein said first and second portions of said attachment device comprise a hook and loop fastener having adhesive surfaces affixed, respectively, to said upright portion within said recessed portion and to said side wall of said trash can.

8. The apparatus of claim 6 wherein said upright portion has a length measured from said engagement portion that is at least twice as long as a length of said engagement portion measured from said upright portion.

9. In combination with a trash can, a hold down apparatus comprising:

an upright portion affixable to a generally upright side wall of a household trash can, said upright portion including an attachment device to permit said upright portion to be affixed to said trash can so as to be movable therewith; and an engagement portion integrally formed with said upright portion but projecting generally orthogonally relative thereto and outwardly relative to said upright side wall, said engagement portion being flexible relative to said upright portion such that said engagement portion is movable relative to said upright portion, said engagement portion being positionable for selective external engagement to prevent upward movement of said trash can due to said upright portion being affixed to said side wall.

10. The apparatus of claim 9 wherein said engagement portion has a transverse width greater than said upright portion.

11. The apparatus of claim 9 wherein said engagement portion is formed with an arched ridge extending across the transverse width of said engagement portion to provide some rigidity to said engagement portion.

12. The apparatus of claim 11 wherein said arched ridge is spaced from said upright portion so as to not restrict movement of said engagement portion relative to said upright portion.

13. The apparatus of claim 9 wherein said upright portion has a rear side formed with a recessed portion into which said attachment device is affixed.

14. The apparatus of claim 13 wherein said attachment device is a hook and loop fastener having adhesive sides affixed, respectively, to said upright portion within said recessed portion and to said side wall of said trash can.

15. The apparatus of claim 9 wherein said upright portion has a length measured from said engagement portion that is at least twice as long as a length of said engagement portion measured from said upright portion.

16. An apparatus in combination with a household trash can to permit said trash can to be restrained from vertical movement when removing a trash bag liner therefrom, the apparatus comprising:

an upright portion configured for attachment to a side portion of said trash can, said upright portion being formed with a recessed portion in a back side thereof;

an engagement portion integrally formed with said upright portion and extending generally orthogonally thereto and outwardly therefrom, said engagement portion being movable relative to said upright portion so as to be able to rest on a support surface on which said trash can is sitting irrespective of the angular orientation of said upright portion when attached to said side portion of said trash can, said engagement portion having a transverse width greater than a corresponding transverse width of said upright portion and being operable, when said engagement portion is temporarily restrained adjacent said support surface and when said upright portion is attached to said side portion of said trash can, to restrict said trash can from vertical movement; and an attachment device adapted to be received within said recessed portion of said upright portion for connecting said upright portion to said side portion of said trash can, said attachment device having an adhesive surface to permit said attachment device to be affixed to said side wall of said trash can to be movable therewith.

17. The apparatus of claim 16 wherein said engagement portion is formed with an arched ridge extending across the transverse width of said engagement portion to provide some rigidity to said engagement portion, said arched ridge being spaced from said upright portion so as to not restrict the flexible movement of said engagement portion relative to said upright portion.

18. The apparatus of claim 17 wherein said attachment device is a hook and loop fastener having adhesive sides affixed, respectively, to said upright portion within said recessed portion and said side of said trash can.

19. The apparatus of claim 18 wherein said upright portion has a length measured from said engagement portion that is at least twice as long as a length of said engagement portion measured from said upright portion.

* * * * *